US010946685B2

(12) United States Patent
Bi et al.

(10) Patent No.: US 10,946,685 B2
(45) **Date of Patent: *Mar. 16, 2021**

(54) SOLIDIFYING WATER-BASED PRINTING FLUID

(71) Applicant: HEWLETT-PACKARD DEVELOPMENT COMPANY, L.P., Spring, TX (US)

(72) Inventors: Yubai Bi, San Diego, CA (US); Alex Veis, Kadima (IL); Gregg A. Lane, San Diego, CA (US); Jon A. Crabtree, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 8 days.

This patent is subject to a terminal disclaimer.

(21) Appl. No.: 16/453,107

(22) Filed: Jun. 26, 2019

(65) Prior Publication Data

US 2019/0315145 A1 Oct. 17, 2019

Related U.S. Application Data

(63) Continuation of application No. 15/760,311, filed as application No. PCT/US2016/014381 on Jan. 21, 2016, now Pat. No. 10,350,929.

(51) Int. Cl.
*B41M 7/00* (2006.01)
*B41J 11/00* (2006.01)

(52) U.S. Cl.
CPC ..... *B41M 7/009* (2013.01); *B41J 11/002* (2013.01); *B41M 7/00* (2013.01)

(58) Field of Classification Search
CPC ..... B41J 11/002; B41J 11/0015; B41M 7/009
USPC ..... 347/101, 102, 105
See application file for complete search history.

(56) References Cited

U.S. PATENT DOCUMENTS

| | | | | |
|---|---|---|---|---|
| 7,422,318 | B2 | 9/2008 | Kitdomatsu et al. | |
| 7,533,983 | B2 | 5/2009 | Hirakawa | |
| 8,053,044 | B2 | 11/2011 | Zhou et al. | |
| 10,350,929 | B2 * | 7/2019 | Bi | B41J 11/002 |
| 2006/0103704 | A1 | 5/2006 | Hakamada et al. | |
| 2009/0068442 | A1 | 3/2009 | Mitsui et al. | |
| 2009/0322811 | A1 | 12/2009 | Higgins et al. | |
| 2010/0152316 | A1 | 6/2010 | Cornell et al. | |
| 2011/0199436 | A1 | 8/2011 | Barreto | |
| 2014/0015907 | A1 | 1/2014 | Takemoto | |

FOREIGN PATENT DOCUMENTS

| | | |
|---|---|---|
| CN | 203713283 | 7/2014 |

* cited by examiner

*Primary Examiner* — An H Do
(74) *Attorney, Agent, or Firm* — Steven R. Ormiston

(57) ABSTRACT

In one example, a process to solidify a water-based printing fluid printed on a substrate includes flushing nonvolatile solvent in the printing fluid into the substrate with the water in the printing fluid.

12 Claims, 4 Drawing Sheets

SOLIDIFYING WATER-BASED PRINTING FLUID

CROSS-REFERENCE TO RELATED APPLICATIONS

This application is a continuation of U.S. application Ser. No. 15/760,311, filed Mar. 15, 2018, which itself is a national stage entry of International Application No. PCT/US2016/014381, filed Jan. 21, 2016, the content of each of which is incorporated by reference herein in its entirety.

BACKGROUND

Non-aqueous solvents are commonly used in water-based inkjet printing inks to inhibit ink drying and clogging nozzles. Non-aqueous solvents with higher boiling points may be used to help reduce the release of volatile organic compounds during printing and drying such inks.

DRAWINGS

Figure 4:
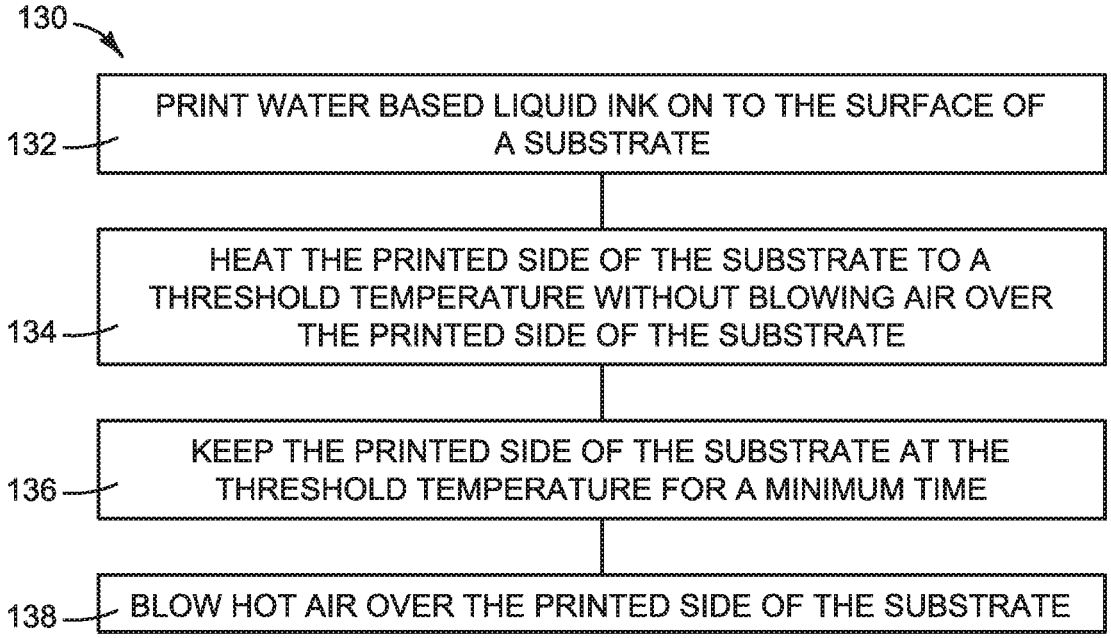
FIG. 4 is a flow diagram illustrating one example of a printing process.

FIGS. 5-9 present a sequence of sections illustrating one example for applying the print process of FIG. 4 to a print substrate.

Figure 10:
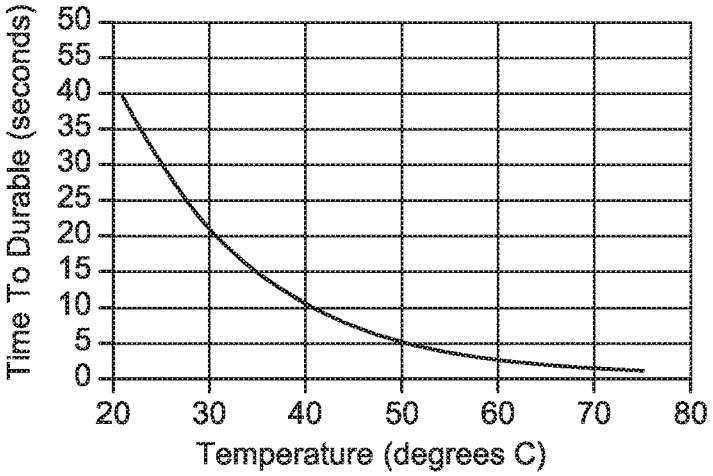

FIG. 10 is a graph illustrating one example of the relationship between substrate temperature and the corresponding time to durability for a water-based ink with a nonvolatile solvent.

Figure 11:
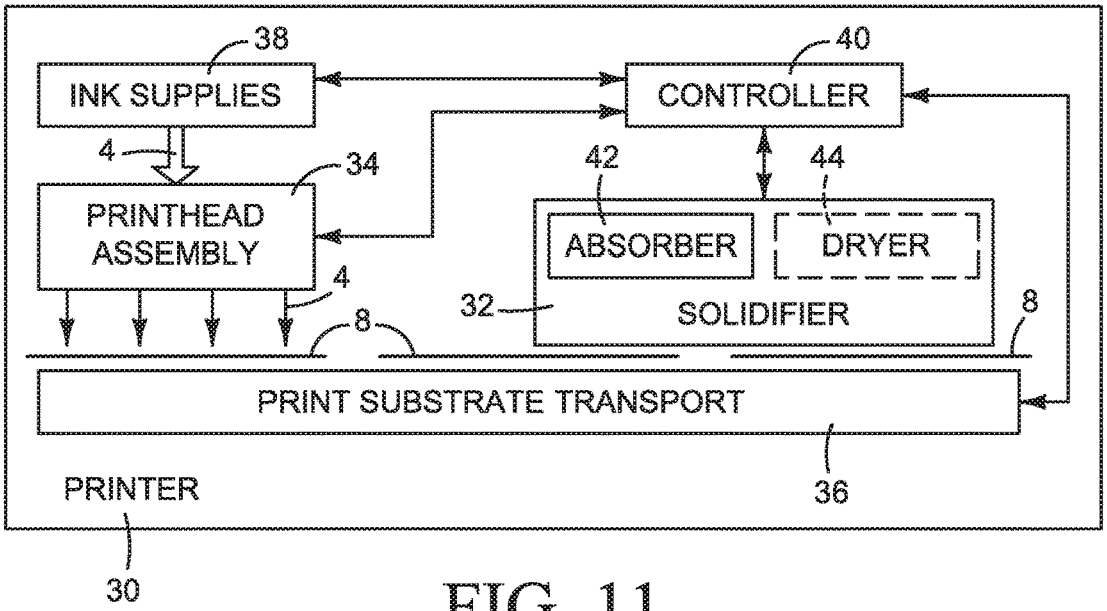

FIG. 11 is a block diagram illustrating an inkjet printer implementing one example of a solidifier to solidify water-based ink dispensed on to a print substrate.

Figure 12:
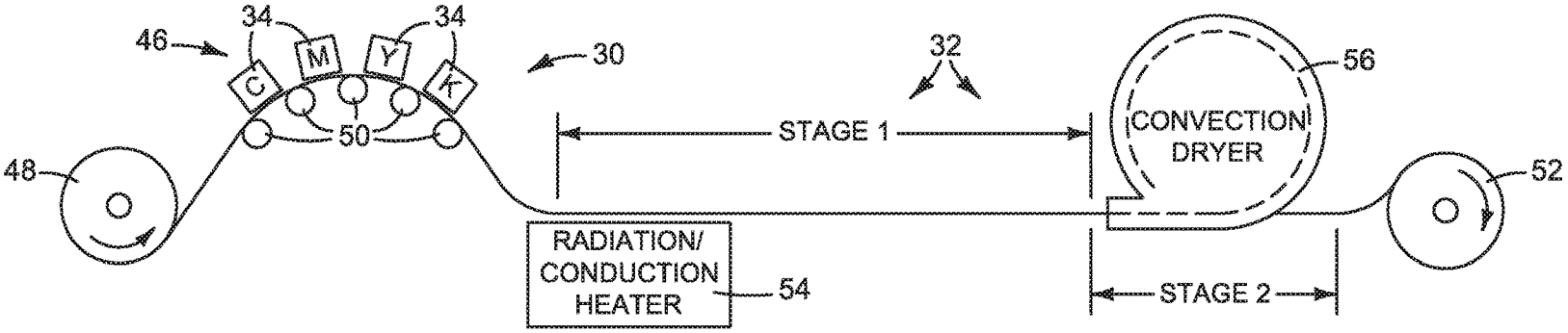

FIG. 12 illustrates an inkjet web printer implementing one example of a two stage solidifier that includes an absorber and a dryer.

Figure 13:
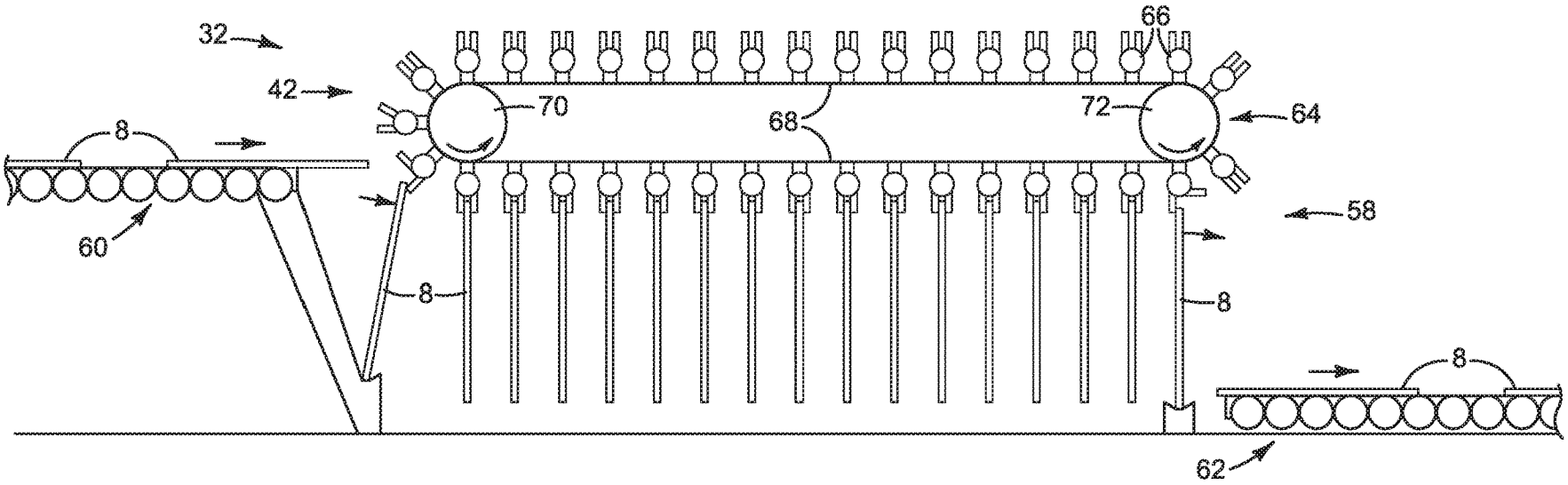

FIG. 13 illustrates one example of a solidifier with an absorber that includes an accumulator, such as might be used in a corrugated board sheet printer.

Figure 14:
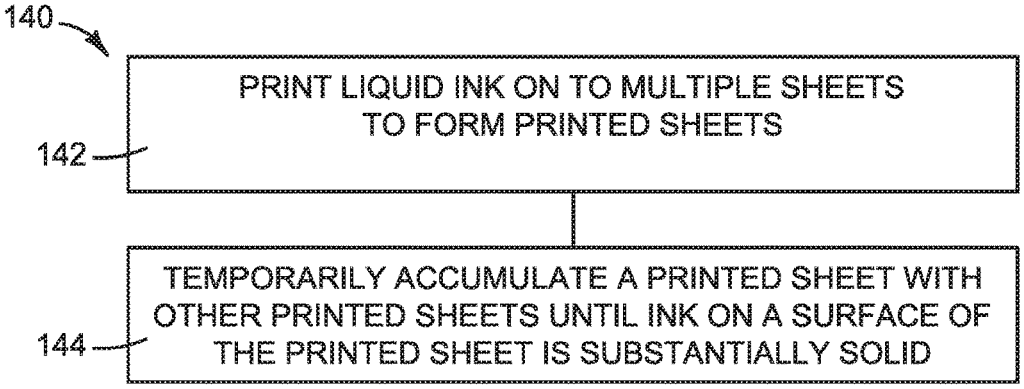

FIG. 14 is a flow diagram illustrating one example of a printing process that includes temporarily accumulating printed sheets to solidify ink printed on the sheets.

The same part numbers designate the same or similar parts throughout the figures. The figures are not necessarily to scale.

DESCRIPTION

A lot of energy is consumed by expensive dryers in high-speed inkjet printers trying to quickly solidify water-based inks after printing. Water-based inkjet printing inks may include a non-aqueous solvent to help keep the ink from drying out before printing and clogging the ink dispensing nozzles. For example, a water-based ink may contain 50% to 90% water and 30% to 0.5% non-aqueous solvent. Non-aqueous solvents with a high boiling point, above 250° C. for example, are frequently used in water-based inks to help reduce the release of volatile organic compounds. Nonvolatile solvents in water-based inks cannot be removed effectively by evaporation and should be absorbed into the substrate before a durable solid film of ink can form on the printed substrate. For high-speed printing in particular, the ink film must become very durable very fast for post-print processing and handling.

In some printing systems, water is removed quickly from the printed substrate. The inventors have discovered, however, that the time to solidify an ink film on the substrate may not depend on the speed at which water is removed, but rather on how fast the nonvolatile solvent in the ink is absorbed into the substrate. Accordingly, quickly removing water from the printed substrate may inhibit absorption of nonvolatile solvents, delaying the formation of a solid, durable ink film on the substrate. Testing shows that when water is completely removed from the ink film on the surface of the substrate, nonvolatile solvent becomes trapped in the film, presumably because of its high viscosity and strong interaction with the colorant, and thereafter takes many minutes or even hours to migrate into the substrate. Thus, there is, in fact, no direct connection between moisture content and solidification/durability for water-based inks with nonvolatile solvents. In some cases, the ink film is not durable even after substantially all of the water is removed because a significant amount of solvent remains in the ink film.

Examples may solidify water-based inkjet printing inks to accelerate solidification and reduce energy consumption and cost to solidify the ink. As described herein, a durable ink film may be formed on the printed substrate even if the underlying substrate is still wet with water. Accordingly, example processes and printing systems may optimize absorption of the nonvolatile solvent into the substrate instead of trying to quickly evaporate water out of the ink. Solvent is absorbed faster in the presence of water, with the water acting as a carrier to "flush" solvent into the substrate. In some examples, water may be actively removed from the substrate once a threshold level of solvent absorption is achieved.

The examples described herein and shown in the figures illustrate but do not limit the scope of the patent, which is defined in the Claims following this Description. Also, while examples are shown and described for inkjet printing inks, other examples are possible, including solidifying other printing fluids and for applications other than inkjet printing.

As used in this document, "colorant" means that part (or those parts) of an ink or other printing fluid that solidifies on the surface of a printed substrate and may include, for example, a pigment and a binder; "durable" and "substantially solid" mean sufficiently solid for further processing; "hot air" means air that is higher than the ambient air temperature; and a "nonvolatile solvent" means a non-aqueous solvent with a boiling point above 250° C. All percentages for components of a printing fluid are by weight.

Figure 1:
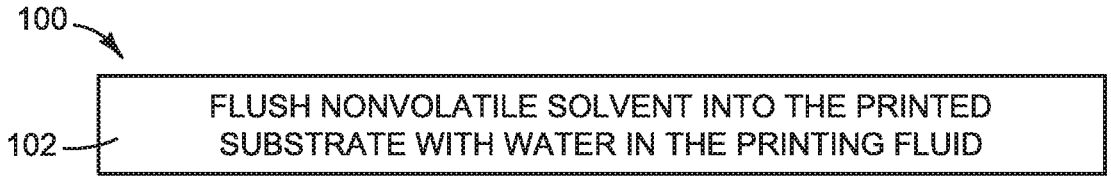
FIG. 1-3 are flow diagrams illustrating example processes for solidifying a water-based ink or other water-based printing fluid that includes a nonvolatile solvent.
Figure 2:
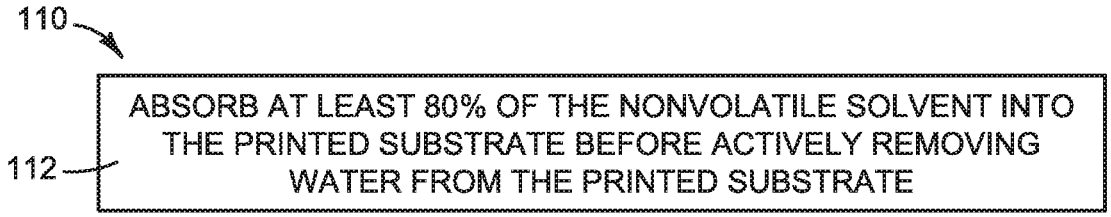
Figure 3:
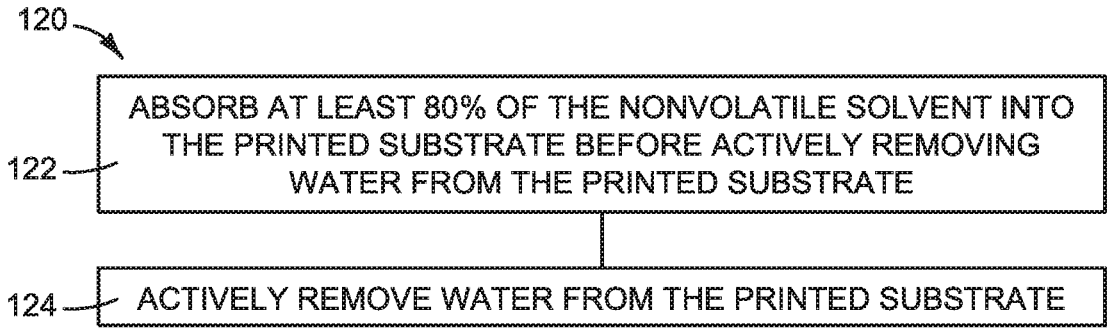

FIGS. 1-3 are flow diagrams illustrating example processes for solidifying an ink or other printing fluid that includes a colorant, water, and a nonvolatile solvent. Other components may be present in water-based printing fluids including, for example, surfactants, buffers, biocides, viscosity modifiers, and stabilizing agents. The solidification process 100 shown in FIG. 1 includes flushing nonvolatile solvent in a water-based ink or other printing fluid into the printed substrate with the water in the printing fluid (block 102), for example by not actively removing water from the substrate until a desired volume of solvent has been absorbed into the substrate. In the solidification process 110 shown in FIG. 2, at least 80% of the nonvolatile solvent is absorbed into the printed substrate before any water is actively removed from the substrate (block 112). The solidification process 120 shown in FIG. 3 includes absorbing at least 80% of the nonvolatile solvent into the printed substrate without actively removing water from the substrate (block 122), and then actively removing water from the substrate (block 124), for example by blowing hot air over the substrate.

For some water-based inkjet printing inks that include a nonvolatile solvent, the ink film will be sufficiently durable for post-print processing when the concentration of solvent in the ink film is below about 20% relative to the colorant. Thus, because little if any of the nonvolatile solvent evaporates at normal printing and drying temperatures, the example solidification processes shown in FIGS. 1 and 2 may produce a sufficiently solid, durable ink film when at least about 80% of the solvent is absorbed into the print substrate. In some implementations, high-speed printing on a continuous thin web substrate for example, it may be desirable to actively remove water from the substrate after a threshold level of solvent is absorbed, as shown at block 124 in FIG. 3, before further post print processing. In other implementations, printing individual sheets of corrugated board for example, it may be possible to continue post print processing without actively removing water from the substrate after a threshold level of solvent is absorbed.

Figure 5:
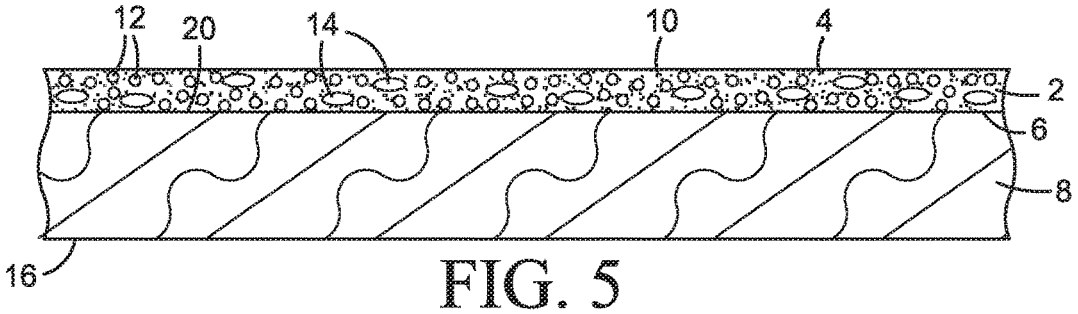

FIG. 4 is a flow diagram illustrating one example of a printing process 130. FIGS. 5-9 present a sequence of sections illustrating one example for applying process 130. At block 132 in FIG. 4, a layer 2 of water-based liquid ink 4 is printed on or otherwise applied to the surface 6 of a substrate 8 as shown in FIG. 5. Liquid ink 4 includes a colorant depicted by stippling 10, water depicted by circles 12, and a nonvolatile solvent depicted by ovals 14. Other components that may be included in a water-based inkjet printing ink 4 are not specifically depicted in FIGS. 5-9.

Figure 6:
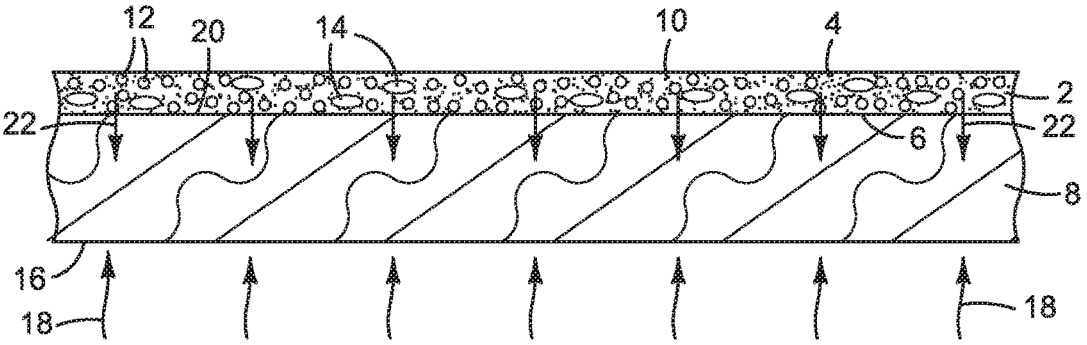
Figure 7:
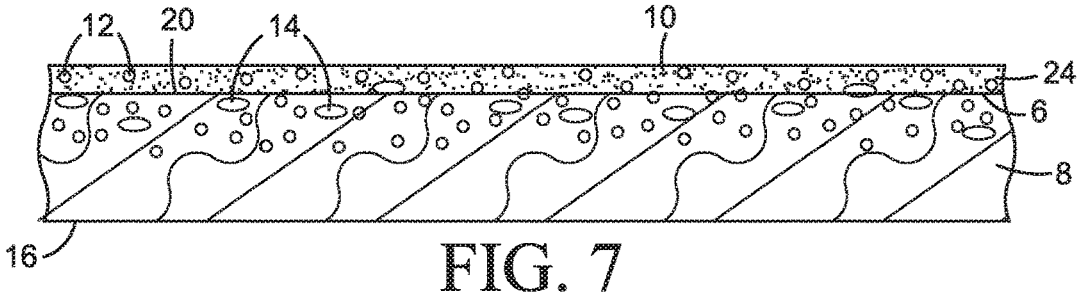
Figure 8:
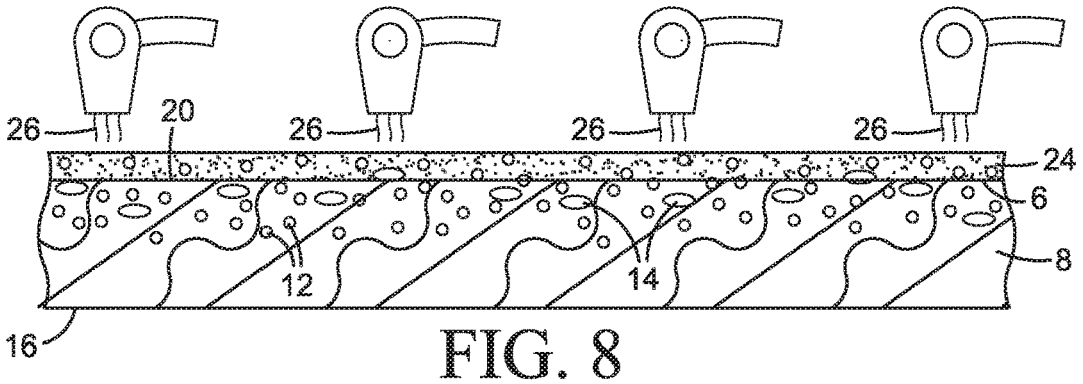
Figure 9:
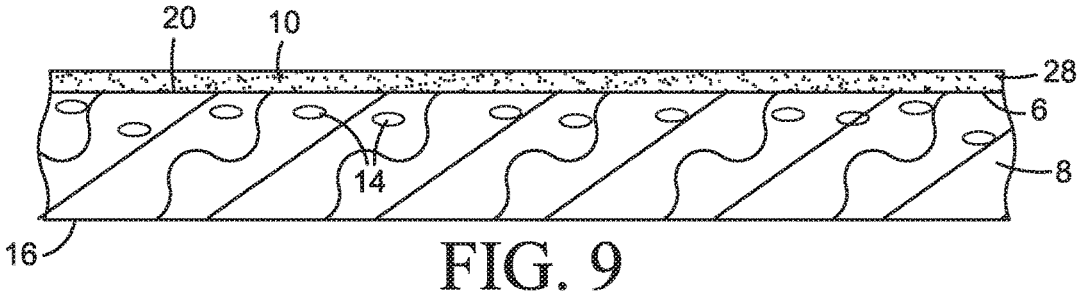

At block 134 in FIG. 4, the printed side 20 of substrate 8 is heated to a threshold temperature without blowing air over printed side 20, for example by exposing the unprinted side 16 to radiant heat 18 until printed side 20 reaches the threshold temperature, as shown in FIG. 6. Heating substrate 8 accelerates the absorption of solvent 14 into substrate 8. The absorption of solvent 14 into substrate 8 is indicated by flow arrows 22 in FIG. 6. Heating substrate 8 without blowing air over printed side 20 reduces the evaporation of water 12 from ink layer 2. The printed side 20 of substrate 8 is kept at the threshold temperature for a minimum time, without blowing air over the printed side of the substrate, to achieve the desired absorption as shown in FIG. 7 (block 136 in FIG. 4). Depending on the level of solvent absorption, ink film 24 in FIG. 7 may be sufficiently durable for post print processing, even though some solvent 14 and some water 12 are still present in film 24. Once the desired level of solvent absorption is achieved, hot air 26 may be blown over printed side 20, if desired, to actively remove water from ink film 24 and substrate 8, as shown in FIG. 8 (block 138 in FIG. 4), to form the substantially dry and durable ink film 24 and substrate 8 shown in FIG. 9.

The temperature of the print substrate effects the rate at which nonvolatile solvent is absorbed into the substrate. The inventors have observed that heating a print substrate increases the rate at which the substrate can absorb nonvolatile solvent, but heating the ink has no appreciable effect on absorption. Testing indicates that the rate of absorption doubles for each increase in substrate temperature of about 10° C. above room temperature. The relationship between substrate temperature and the corresponding time to durable is shown in the graph of FIG. 10 for a water-based ink containing 2%-4% polymer pigment, about 10% binder, about 10% nonvolatile solvent, and 70%-75% water. As shown in FIG. 10, it takes about 40 seconds after printing for the ink film to become durable with the substrate at room temperature, about 21° C. If the substrate is heated to about 31° C. before or immediately after printing, it takes about 20 seconds for the ink film to become durable, and so on up to about 70° C. where a durable in film is achieved in less than 2 seconds.

For thicker substrates that are harder to heat and/or for slower post print processing, a lower substrate temperature with slower absorption may be desirable, for example to help lower energy consumption. For thinner substrates that are easier to heat and/or for higher speed post print processing, a higher substrate temperature with faster absorption may be desirable, for example to help increase throughput. While the temperature and time at temperature may vary depending on the characteristics of the printing fluid and the print substrate, it is expected that substrate temperatures in the range of 50° C. to 70° C. will be sufficient to achieve the desired level of solvent absorption for many water-based inkjet inks and substrates in less than 5 seconds. Of course, other substrate temperatures and times at temperature are possible. For example, for high-speed inkjet printing on a thinner, plain paper web substrate, it may be desirable (and practical) to heat the substrate to as high as 200° C. to reach durability in significantly less than 2 seconds. For another example, for inkjet printing on a thicker, corrugated board substrate, it may be desirable (and practical) to leave the substrate at room temperature.

In the example shown in FIGS. 4-9, absorption is the only vehicle for significant mass transfer of nonvolatile solvent 14 out of ink layer 2. The inventors have shown that the presence of water 12 in ink layer 2 increases the rate of mass transfer of solvent 14 out of ink layer 2, compared to quickly evaporating water 12 from the ink. Water carries solvent into the substrate. Evaporating water too quickly inhibits absorption. For example, as shown in FIG. 10, testing carried out with water-based inks containing 2%-4% polymer pigment, about 10% binder, about 10% nonvolatile solvent, and 70%-75% water shows that the ink film on a printed substrate is durable about 40 seconds after printing when allowed to solidify with the substrate at room temperature (about 21° C.) without blowing air. By contrast, the same inks take 45 minutes or more to reach durability after just five seconds in a dryer blowing 190° C. air on the ink immediately after printing. Thus, while ink film durability depends on effectively removing water and solvent from the ink, it is now known that removing water from the ink too quickly impedes absorption and thus slows solvent removal. Accordingly, the ink film solidification process should be optimized for solvent absorption rather than for water removal.

FIG. 11 is a block diagram illustrating an inkjet printer or other printing system 30 implementing one example of a solidifier 32 to solidify ink or other printing fluid dispensed on to a substrate 8. An inkjet printing system 30 may be implemented with a solidifier 32 integral to the printer, as shown in FIG. 11, or with solidifier 32 as a discrete post-print component separate from the printer. Referring to FIG. 11, printer 30 includes a printhead assembly 34, a print substrate transport system 36 for moving substrate 8 past printhead assembly 34, and ink supplies 38 for supplying ink 4 on to a sheet or continuous web of print substrate 8. Printhead assembly 34 may be implemented as one or multiple stationary units with a substrate wide array of printheads or as one or multiple carriage mounted units to scan the printhead(s) back and forth across substrate 8. Printer 30 also includes a controller 40 which represents generally the programming, processor(s) and associated memories, and the electronic circuitry and components needed to control the operative elements of printer 30.

In the example shown in FIG. 11, solidifier 32 includes a first stage, absorber 42 and may include a second stage, dryer 44. Absorber 42 is configured to keep the substrate wet until a threshold level of nonvolatile solvent is absorbed into the substrate, for example by not blowing hot air on to the substrate for a minimum period of time after printing and/or until the ink film on the surface of the substrate is substantially solid. Dryer 44 is configured to actively remove water from the ink film and from the substrate after a threshold level of solvent is absorbed into the substrate, for example by blowing hot air on to the substrate after the minimum period of time has elapsed. For high-speed inkjet printing on a paper or other thinner substrate, for example, it may be desirable to utilize a two stage solidifier 32 (with a dryer 44) to actively remove water from the substrate to help maintain the mechanical integrity of the substrate for post print processing. For inkjet printing on a corrugated board or other thicker substrate that can absorb and hold water without degrading the mechanical integrity of the substrate, a single stage solidifier 32 (without a dryer 44) may be desirable.

FIG. 12 illustrates an inkjet web printer 30 implementing one example of a two stage solidifier 32 in which the absorber 42 includes a substrate heater, such as might be used in a high-speed inkjet printing press. Referring to FIG. 12, printer 30 includes an arched printing unit 46 with four printhead assemblies 34, for example to dispense cyan (M), magenta (M), yellow (Y) and black (K) ink on to a web substrate 8. Substrate 8 is supplied to printing unit 46 from a supply spool 48 and moved past printheads 34 on rollers 50. Printed substrate 8 moves through solidifier stages 1 and 2 to a take-up spool 52. Solidifier 32 includes an absorber 42 (at stage 1) and a dryer 44 (at stage 2). In this example, absorber 42 includes a radiation and/or conduction heater 54 to heat substrate 8, without convection, at the beginning of stage 1 immediately after printing. A radiation heater 54 may be implemented, for example, as an infrared, ultraviolet, or microwave radiation source. A conduction heater 54 may be implemented, for example, as a heated roller or belt. Dryer 44 includes a convection dryer 56 configured to blow hot air on to substrate 8 at stage 2.

In the example shown in FIG. 12, stage 1 heater 54 is configured to heat the printed side of substrate 8 by applying heat to the unprinted side of the substrate. Heating the unprinted of the substrate without convection may be more efficient and effective in some printing applications to accelerate absorption compared to heating the substrate through the ink on the printed side of the substrate. Heating the substrate indirectly through the ink can slow heat transfer to the substrate and evaporate water from the ink that otherwise may help flush solvent into the substrate. However, for thicker substrates that do not efficiently transfer heat from the unprinted side to the printed side, it may be desirable to heat the substrate from the printed side. In one example, absorber heater 54 is implemented as an IR lamp with sufficient power to heat a moving web substrate 8 to 70° C. to 80° C. in about 0.5 seconds. For a water-based ink with up to 30% nonvolatile solvent, the ink film on the surface of a 70° C. to 80° C. substrate will be substantially solid in less than 2 seconds.

FIG. 13 illustrates another example of a solidifier 32 that includes an absorber 42 with an accumulator 58 to promote absorption to solidify the ink film on a printed sheet substrate 8. Referring to FIG. 13, substrate sheets 8 printed with liquid ink are supplied to accumulator 58, for example along a roller conveyor 60. Sheets 8 in FIG. 13 represent, for example, sheets of corrugated board and other rigid or semi-rigid print substrates. Substrate sheets 8 with a durable ink film are discharged from accumulator 58, for example on to a roller conveyor 62. In the example shown in FIG. 13, accumulator 58 is configured as a hanger conveyor 64 that includes grippers 66 carried along an endless loop track 68 driven at one or both rollers 70, 72. A gripper 66 grabs a wet sheet 8 from input conveyor 60, carries it vertically along the lower run of track 68, and discharges it to output conveyor 62. Each sheet 8 hangs vertically as it moves between conveyors 60, 62, spaced apart from the adjacent sheets so that the printed side of each sheet does not touch another sheet.

While it may be desirable in some implementations to discharge a sheet 8 from an accumulator 58 before the ink film is durable, it is expected that each sheet 8 usually will be in an accumulator 58 long enough for the ink film to become durable. Accumulator 58 may be configured to have the same downstream throughput as input conveyor 60, for example by temporarily reorienting each sheet as shown in FIG. 13. Arranging sheets vertically in the accumulator enables closer spacing in the downstream direction, and thus slower speed through the accumulator and more time in the accumulator, for better absorption.

FIG. 14 is a flow diagram illustrating one example of a printing process 140 for a water-based ink or other printing fluid that includes a nonvolatile solvent. Process 140 may be implemented, for example, with a printer using an accumulator 58 shown in FIG. 13. Referring to FIG. 14, printing fluid is printed on multiple sheets to form printed sheets (block 142). A printed sheet is temporarily accumulated with other printed sheets, with the printed side of each sheet spaced apart from and not touching an adjacent sheet, until the printing fluid on the surface of the sheet is durable (block 144).

"A", "an" and "the" used in the claims means at least one.

The examples shown in the figures and described above illustrate but do not limit the patent, which is defined in the following Claims.

The invention claimed is:

1. A printing process for a liquid ink that includes a colorant, water, and a nonvolatile solvent, the process comprising:

printing the ink on an absorbent substrate; and absorbing at least 80% of the nonvolatile solvent into the substrate without actively removing water from the substrate.

2. The process of claim 1, wherein the absorbing comprises temporarily accumulating a printed substrate sheet wet with the water with other printed substrate sheets with the printed side of each sheet spaced apart from and not touching an adjacent sheet until the colorant is substantially solid.

3. The process of claim 1, wherein the absorbing comprises exposing an unprinted side of the printed substrate to radiant and/or conductive heat until a printed side of the substrate reaches a threshold temperature and remains at or above the threshold temperature for a period of time.

4. The process of claim 3, wherein the threshold temperature is at least 50° C. and the period of time is less than 5 seconds.

5. The process of claim 3, wherein the threshold temperature is at least 70° C. and the period of time is less than 2 seconds.

6. The process of claim 1, comprising, after absorbing at least 80% of the nonvolatile solvent into the substrate, actively removing water from the substrate.

7. The process of claim 6, where actively removing water from the substrate comprises blowing hot air over the substrate.

8. A printing process for a liquid ink that includes a colorant, water, and a nonvolatile solvent, the process comprising:

printing the ink on an absorbent substrate; and heating the printed substrate to at least 70° C. in less than 1 second without blowing hot air over the printed substrate.

9. The process of claim 8, comprising, after heating the printed substrate to at least 70° C. in less than 1 second without blowing hot air over the printed substrate, blowing hot air over the printed substrate.

10. The process of claim 9, wherein the heating comprises exposing an unprinted side of the printed substrate to radiant and/or conductive heat.

11. A printing process for a liquid ink that includes a colorant, water, and a nonvolatile solvent, the process comprising:

printing the ink on an absorbent substrate sheet; and holding the printed substrate sheet at room temperature for at least 40 seconds immediately after printing.

12. The process of claim 11, wherein the holding comprises temporarily accumulating the printed substrate sheet wet with the water with other printed substrate sheets with the printed side of each sheet spaced apart from and not touching an adjacent sheet until the colorant is substantially solid.

* * * * *